US009587415B2

(12) United States Patent
Walls et al.

(10) Patent No.: US 9,587,415 B2
(45) Date of Patent: Mar. 7, 2017

(54) SIDEBIT OPERATED INTERCHANGEABLE CORE CONTROL LUG

(71) Applicant: Schlage Lock Company LLC, Indianapolis, IN (US)

(72) Inventors: Brian Edward Walls, Colorado Springs, CO (US); Ajeya Suratkal Rao, Karnataka (IN); Evan Earl Evans, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 14/189,729

(22) Filed: Feb. 25, 2014

(65) Prior Publication Data

US 2015/0240525 A1 Aug. 27, 2015

(51) Int. Cl.

| | |
|---|---|
| ***E05B 9/08*** | (2006.01) |
| ***E05B 27/00*** | (2006.01) |
| ***E05B 35/14*** | (2006.01) |
| *E05B 27/10* | (2006.01) |

(52) U.S. Cl.

CPC ..... *E05B 9/086* (2013.01); *E05B 27/0053* (2013.01); *E05B 35/14* (2013.01); *E05B 2027/10* (2013.01); *Y10T 70/7486* (2015.04); *Y10T 70/8432* (2015.04)

(58) Field of Classification Search

CPC ..... E05B 27/0003; E05B 15/00; E05B 9/086; E05B 9/084; E05B 27/0053; E05B 27/0017; E05B 2027/0015; E05B 2027/10; E05B 35/14; Y10T 70/8432; Y10T 70/7486

USPC ..... 70/337, 340, 348, 390, 491, 493, 367, 70/369, 370, 371, 372, 419, 421

See application file for complete search history.

(56) References Cited

U.S. PATENT DOCUMENTS

| | | | | |
|---|---|---|---|---|
| 3,793,857 A | | 2/1974 | Schlage | |
| 4,282,731 A | * | 8/1981 | Taksony | 70/493 |
| 4,328,690 A | * | 5/1982 | Oliver | 70/369 |
| 4,386,510 A | * | 6/1983 | Best et al. | 70/369 |
| 5,070,715 A | * | 12/1991 | Smallegan et al. | 70/369 |

(Continued)

OTHER PUBLICATIONS

International Search Report; International Searching Authority; International PCT Application No. PCT/US2015/017284; May 26, 2015; 2 pages.

(Continued)

*Primary Examiner* — Christopher Boswell
*Assistant Examiner* — Amanda L Miller
(74) *Attorney, Agent, or Firm* — Taft Stettinius & Hollister LLP

(57) ABSTRACT

A retention mechanism for retaining a lock cylinder in a lock housing. The retention mechanism includes a control lug, a control pin, and a finger pin. A portion of the control lug is configured to be positioned in a retention recess of the lock housing when the control lug is in an engagement position to prevent the removal of the lock cylinder from the lock housing. With the control lug in the engaged position, at least a portion of the control pin may be biased into a chamber of the control lug to retain the control lug at the engaged position. When the control lug is to be displaced from the engaged position, the finger pin may be lifted to an activation position, such as by a sidebit of a key, wherein the finger pin may removably displace the control pin from at least a portion of the chamber.

20 Claims, 7 Drawing Sheets

(56) References Cited

U.S. PATENT DOCUMENTS

| | | | | |
|---|---|---|---|---|
| 5,615,566 | A | 4/1997 | Brandt | |
| 6,516,644 | B1 | 2/2003 | Seliber | |
| 6,578,396 | B2 | 6/2003 | Field et al. | |
| 8,117,876 | B2 | 2/2012 | Mathachan | |
| 8,336,349 | B2 * | 12/2012 | Thimmappa et al. | 70/371 |
| 2002/0170326 | A1 * | 11/2002 | Field et al. | 70/371 |
| 2008/0196461 | A1 * | 8/2008 | Widen | 70/409 |
| 2009/0241620 | A1 * | 10/2009 | Field | E05B 27/0035 70/360 |
| 2011/0056258 | A1 * | 3/2011 | Widen | 70/406 |
| 2012/0240645 | A1 * | 9/2012 | Mathachan | 70/491 |

OTHER PUBLICATIONS

Written Opinion; International Searching Authority; International PCT Application No. PCT/US2015/017284; May 26, 2015; 4 pages.

* cited by examiner

SIDEBIT OPERATED INTERCHANGEABLE CORE CONTROL LUG

BACKGROUND OF THE INVENTION

Interchangeable lock cylinders, such as, for example, interchangeable core (IC) cylinders, often employ pin tumbler lock mechanisms. Pin tumbler lock mechanisms typically utilize the alignment and misalignment of tumbler pins to control both the operation of an associated lock device and the ability to remove the IC cylinder from a lock housing. For example, with at least certain types of pin tumbler lock mechanisms, in the absence of a valid key being inserted into a key slot of an IC cylinder, tumbler pins typically are biased to be misaligned with, or extend across, both a control shear line and an operating shear line.

When tumbler pins are misaligned with the operating shear line, a plug body of the IC cylinder is typically unable to rotate within the IC cylinder. As the plug body is often operably connected to the lock device, such as, for example, a deadbolt, the inability to rotate the plug body typically results in the inability to displace the lock device from a locked position to an unlocked position, and/or vice versa. Thus, typically in order to lock/unlock the lock device, a first key, such as, for example, an operating key, having the appropriate bitting configuration is placed within a key slot of the plug body. When properly inserted into the key slot, the bittings of the operating key engage and displace tumbler pins to positions in which tumbler pins that are adjacent to the operating shear line, such as, for example, bottom pins, do not extend across the operating shear line while other pins, such as top pins, remain misaligned with the control shear line. With tumbler pins properly aligned with the operating shear line, the plug body may be rotated independently of a control lug of the IC cylinder. Such rotation of the plug body, and associated inability to rotate the control lug, may allow for the displacement of the lock device while prohibiting the removal of the IC cylinder from the lock housing.

Similarly, when tumbler pins, such as top pins, do not extend across the control shear line, the control lug is typically able to rotate within the IC cylinder. The rotational displacement of the control lug is often necessary to displace a retention portion of the control lug from a recess in the lock housing before the IC cylinder may be removed from the lock housing. Thus, the removal of the IC cylinder from the lock housing typically involves the insertion of a second key, such as, for example, a control key, that has an appropriate key bitting configuration to be used in displacing the tumbler pins that are adjacent to the control shear line. Moreover, the bitting of the control key is typically configured so that, when the control key is inserted into the key slot, the top pins are aligned with and/or do not extend across the control shear line. With tumbler pins properly aligned with the control shear line, the control lug may be rotated, which may thereby displace the retention portion so that the IC cylinder may be removed from the lock housing. During such uses of the control key, tumbler pins may continue to be misaligned with the operating shear line, thereby preventing the plug body from being rotated independently of the control lug.

With traditional pin tumbler lock mechanisms, there are a finite number of possible bitting combinations. For example, the possible number of bitting combinations may be defined by the number of bittings in a key system raised to the power of the number of pin chambers in the IC cylinder. For example, if a bitting system uses ten different cuts for the blade of a key, and the IC cylinder has six chambers or collections of tumbler pins, then the number of possible bitting combinations is ten to the sixth power. However, in application, the number of bitting combinations actually used is often less than the number of possible bitting combinations. For example, the number of bitting combinations actually used may be reduced due to manufacturing, mechanical, and/or security concerns, including issues related to reducing the potential for cross keying, phantom master keys, and/or phantom control keys. The number of usable bitting combinations is often further reduced in order to accommodate the ability for each cylinder to have a pin configuration that allows for tumbler pins to align with operating shear line during certain uses and the control shear line during other uses. Additionally, lock mechanisms designed to actuate the control lug off of the position of top pins are generally limited to using traditional tumbler pin systems. Further, the use of different bitting configurations for aligning tumbler pins to both control activation of the lock device and/or removal of the IC cylinder is not necessarily compatible with certain types of interchangeable lock cylinders.

BRIEF SUMMARY OF THE INVENTION

One aspect of the present invention is a retention mechanism for retaining a lock cylinder in a lock housing. The retention mechanism may include a control lug having a chamber. Further, the control lug is configured for rotational displacement between a disengaged position and an engaged position in the lock cylinder. The retention mechanism may also include a control pin, at least a portion of the control pin being configured to be displaced into the chamber to prevent rotational displacement of the control lug from the engaged position. Additionally, the retention mechanism may include a finger pin that has an activation surface. The finger pin is configured for displacement between a rest position and an activation position. Further, the activation surface is configured to removably displace at least a portion of the control pin from the chamber when the finger pin is displaced to the activation position.

Another aspect of the present invention is an interchangeable lock cylinder that is configured for securable placement in a lock housing. The interchangeable lock cylinder includes a shell body having an aperture and a plug body that is configured for rotational displacement about the aperture. The plug body includes a key slot. The interchangeable lock cylinder also includes a retention mechanism having a control lug, a finger pin, and a control pin. The control lug includes a chamber and an orifice, the orifice being configured to receive the rotatable insertion of the plug body. Further, the control pin is configured for removable insertion into the chamber when the control lug is rotatably displaced to an engaged position. Additionally, the finger pin is configured to displace the control pin from the chamber.

Another aspect of the present invention is an interchangeable lock cylinder system that includes a plug body having a key slot and a retention mechanism. The retention mechanism includes a control lug, a finger pin, and a control pin. The control lug has a chamber and an orifice, the orifice being configured to receive the rotatable insertion of the plug body. Additionally, the control pin is configured for removable insertion into the chamber when the control lug is rotatably displaced to an engaged position. The interchangeable lock cylinder system also includes a key having a sidebit, the key being configured to be inserted into the key slot. The sidebit is configured to displace the finger pin from a rest position to an activation position. Further, the finger pin is configured to removably displace the control pin from the chamber when the finger pin is in the activation position.

Figure 1A:
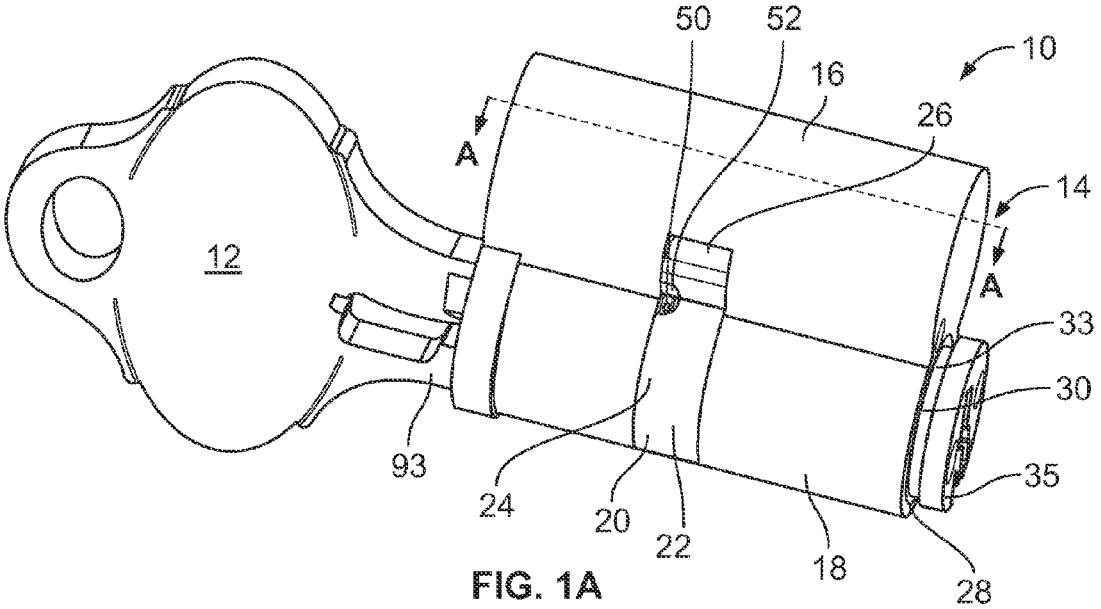
FIG. 1A illustrates a perspective side view of a lock cylinder engaged by a key according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

Referencing FIGS. 1A-3, embodiments of the present invention include a lock cylinder 10 having a shell body 14 that is configured for removable insertion into a lock housing 11. The shell body 14 includes an upper portion 16 and a lower portion 18. According to certain embodiments, the shell body 14 may also include a circumferential groove 20 that extends along at least a portion of the shell body 14. According to such embodiments, the circumferential groove 20 is configured to receive and/or accommodate the rotational displacement of a control lug 22. The control lug 22 includes a body portion 24, an orifice 25, and a retention portion 26. Additionally, the control lug 22 is configured for at least a portion of the retention portion 26 to be rotatably displaced into, and out of, a retention recess 13 of the lock housing 11 so as to control the removal of the lock cylinder 10 from the lock housing 11.

The lower portion 18 of the lock cylinder 10 includes an aperture 28 that is configured to receive the insertion of a plug body 30. The plug body 30 is configured for rotational displacement within the aperture 28. Additionally, according to certain embodiments, the plug body 30 is configured for rotational displacement about the orifice 25 of the control lug 22. The plug body 30 includes a first end 31 and a second end 33. Optionally, according to certain embodiments, the first end 31 of the plug body 30 may be larger than the aperture 28 so as to prevent the first end 31 from being displaced into the aperture 28. Additionally, the second end 33 may be configured to be operably connected to a plug disk 35. According to certain embodiments, the plug disk 35 may be operably connected to a lock device. According to such a configuration, the rotational displacement of the plug body 30, and associated displacement of the plug disk 35, may be translated into the displacement of at least a portion of the lock device, such as, for example, the displacement of a dead bolt from a locked position to an unlocked position, and/or vice versa. Additionally, the plug disk 35 may at least assist in retaining the plug body 30 in the aperture 28.

Figure 1B:
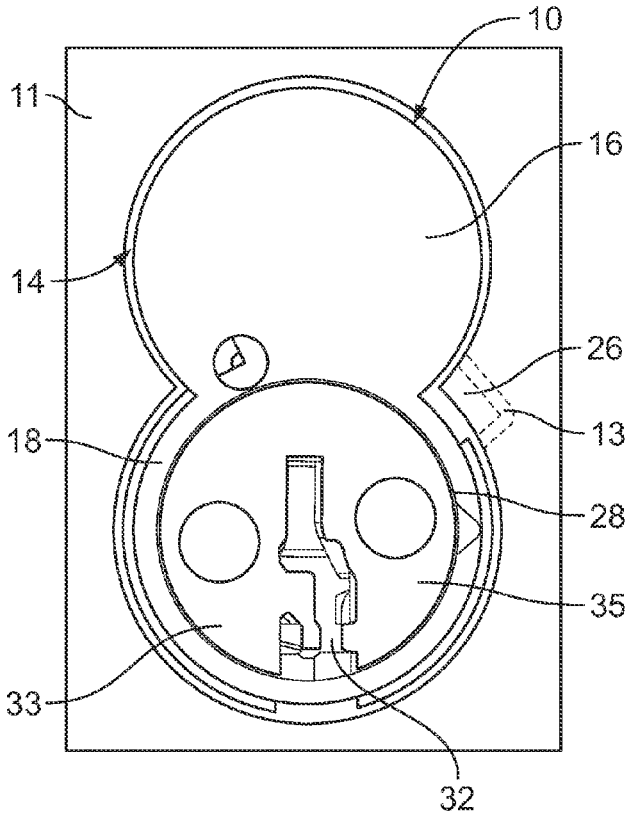
FIG. 1B illustrates a rear view of a lock cylinder positioned within a lock housing according to an embodiment of the present invention.
Figure 2:
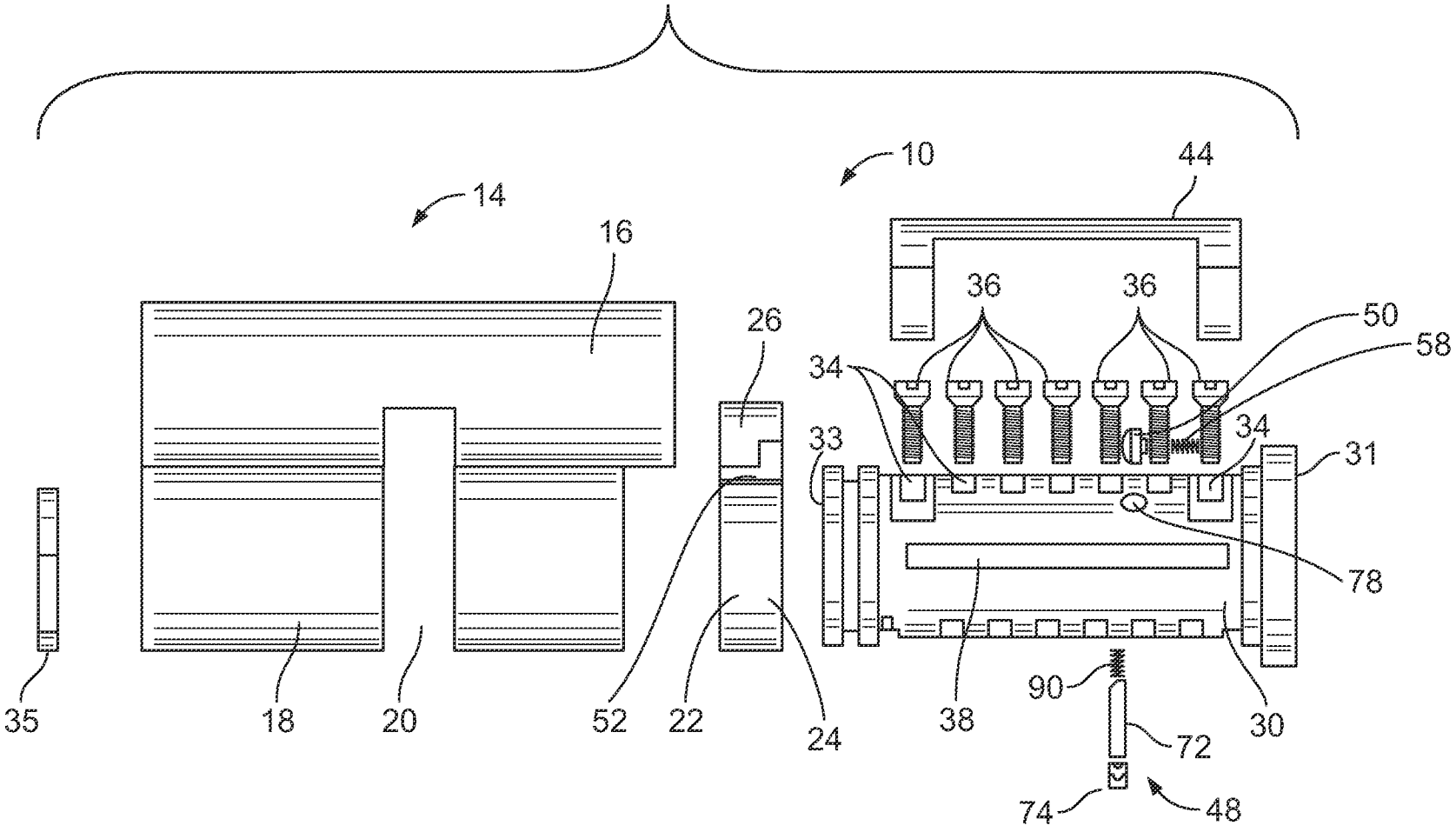
FIG. 2 illustrates an exploded view of a lock cylinder according to an embodiment of the present invention.
Figure 4:
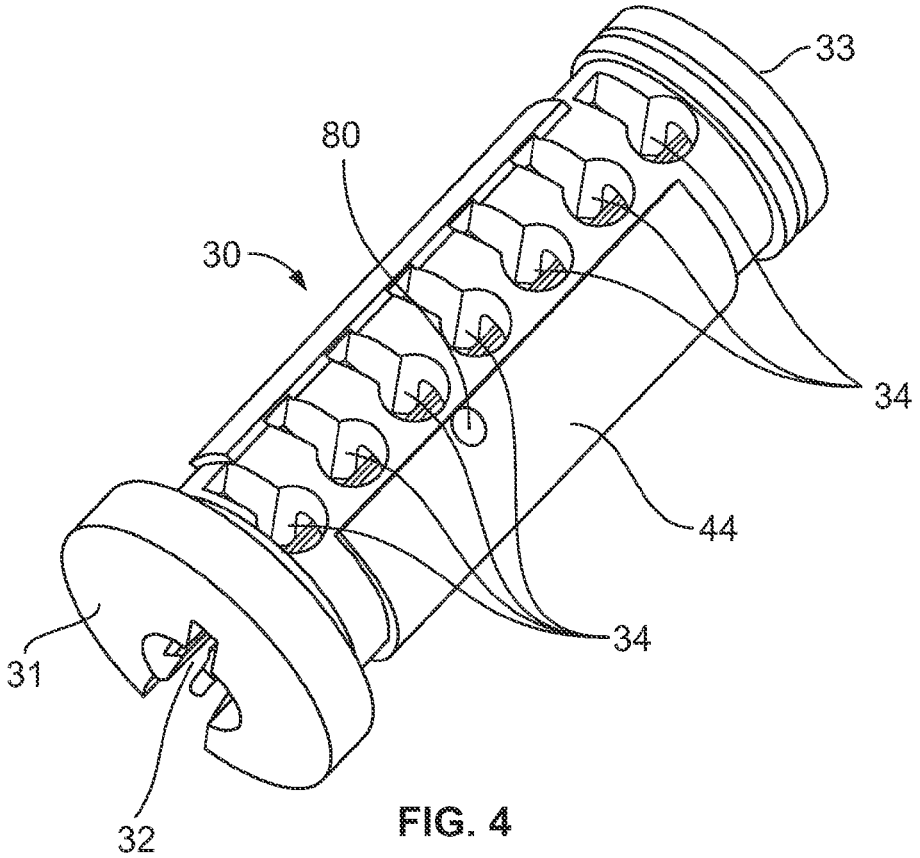
FIG. 4 illustrates a perspective top view of a plug body having a cover in an open position according to an embodiment of the present invention.

As shown in at least FIGS. 1 and 4, the plug body 30 includes a key slot 32 that is configured to receive the removable insertion of a key 12. Additionally, according to certain embodiments, the plug body 30 includes a plurality of cavities 34 that are configured to contain one or more retention pins 36, such as, for example, tumbler retention pins. According to certain embodiments, when the lock cylinder 10 is to be in a locked position, the retention pins 36 are biased, such as, for example, by springs, so as to at least assist in preventing the rotational displacement of the plug body 30. For example, according to certain embodiments, one or more of the retention pins 36 may extend out of the cavities 34 so as to be misaligned with an operating shear line between the plug body 30 and the shell body 14, thereby preventing the rotational displacement of the plug body 30 relative to the shell body 14 and/or control lug 22. According to other embodiments, the retention pins 36 may outwardly bias a control bar 38 into a recess 40 in the shell body 14 and/or control lug 22, as shown for example in at least FIGS. 2 and 9, so as to prevent the rotational displacement of the plug body 30 relative to the shell body 14 and/or control lug 22. When a key 12, such as, for example, an operating key, is inserted into the key slot 32, the bitting configuration of the key 12 may cause the displacement of the retention pins 36 such that retention pins 36 are aligned with the operating shear line, or are displaced to positions that allow for the retraction of the control bar 38 from the recess 40 of the shell body 14 and/or control lug 22, thereby allowing for rotational movement of the plug body 30.

According to certain embodiments, the lock cylinder 10 may also include a cover 44 that is configured to at least assist in retaining the retention pins 36 within the cavities 34 when the plug body 30 is removed from the aperture 28 of the shell body 14. More specifically, when the plug body 30 is removed from the aperture 28, the cover 44 may be in a closed position such that at least a portion of the cover 44 is positioned over at least a portion of the cavities 34, thereby preventing the release of the retention pins 36 from the cavities 34. Further, when the plug body 30 is positioned within the aperture 28, the cover 44 may be rotated to an open position, in which the cover 44 does not cover or otherwise provide a barrier over the cavities 34, thereby allowing at least a portion of the retention pins 36 to extend out of the cavities 34.

Figure 9:
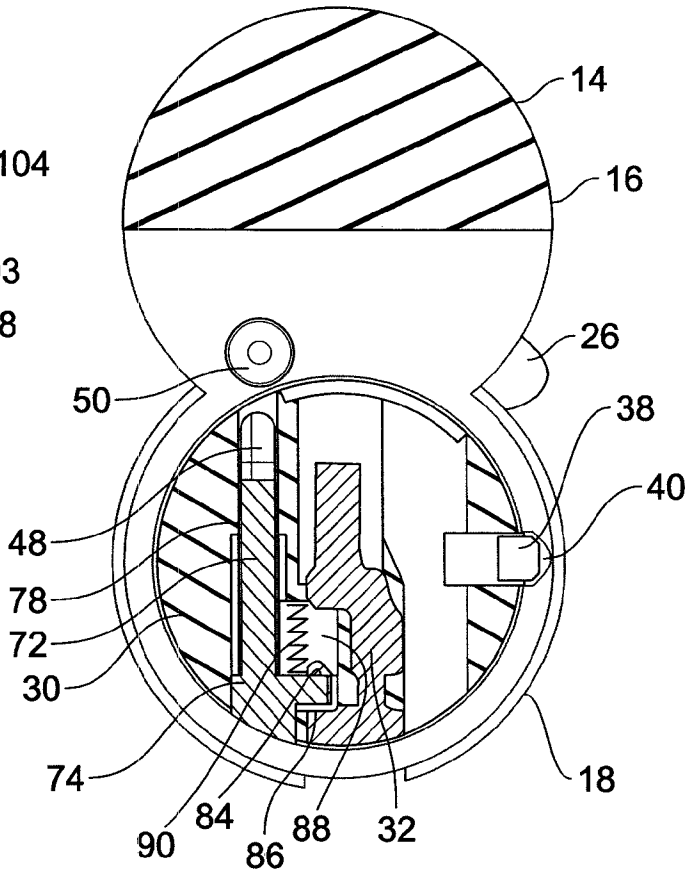
FIG. 9 illustrates a cross sectional view of a lock cylinder with a retention mechanism in a retention position according to an embodiment of the present invention.

Referencing FIG. 9, the lock cylinder 10 may be secured to the lock housing 11 by the rotational displacement of the control lug 22, and associated displacement of the retention portion 26. More specifically, the control lug 22 may be rotated from a disengaged position, in which the retention portion 26 is not in the retention recess 13 of the lock housing 11, to a engaged position, wherein at least a portion of the retention portion 26 occupies at least a portion of the retention recess 13 in a manner that prevents the lock cylinder 10 from being removed from the lock housing 11.

The rotational displacement of the control lug 22 from the disengaged position to the engaged position, and associated displacement of the retention portion 26, may be achieved in a variety of different manners. For example, according to certain embodiments, the recess 40 of the control lug 22 may be offset from the control bar 38 when the lock cylinder 10 is at least initially positioned within the lock housing 11. Subsequent rotational displacement of the plug body 30, such as, for example, insertion and rotation of an appropriate key 12 in the key slot 32 may rotably displace the plug body 30, thereby at least also rotably displacing the control bar 38. Thus, the control bar 38 may be rotated to a position in which the control bar 38 is received into the recess 40 of the control lug 22. With at least a portion of the control bar 38 positioned within the recess 40 of the control lug 22, the direction of rotation of the key 12 may be reversed, thereby causing the control lug 22 to be rotated with the plug body 30. According to certain embodiments, as the control lug 22 is rotated from the disengaged position to the engaged position, at least a portion of the retention portion 26 of the control lug 22 enters into the retention recess 13 of the lock housing 11. The control lug 22 may continue to be rotated until the control lug 22 reaches the engaged position, wherein the retention portion 26 is positioned within and/or engages the retention recess 13 in a manner that prevents the lock cylinder 10 from being removed from the lock housing 11.

Embodiments of the present invention further include a retention mechanism 46 that is configured to at least assist in controlling the displacement of the control lug 22 from the engaged position to the disengaged position, and thus generally control the ability to remove of the lock cylinder 10 from the lock housing 11. According to certain embodiments, the retention mechanism 46 includes the control lug 22, a finger pin 48, and a control pin 50. When the retention mechanism 46 is in the retention position, the control pin 50 is positioned within a chamber 52 of the control lug 22 so as to retain the control lug 22 in the engaged position. According to certain embodiments, the chamber 52 may be configured to receive the insertion of at least a portion of the control pin 50 as the control lug 22 is rotated from the disengaged position and toward the engaged position and/or upon the control lug 22 reaching the engaged position.

Figure 5:
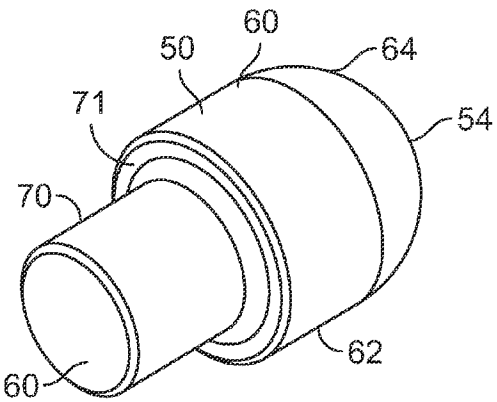
FIG. 5 illustrates a rear perspective view of a control pin according to an embodiment of the present invention.
Figure 6:
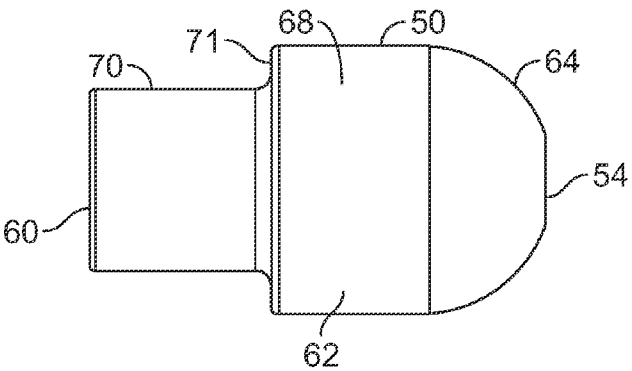
FIG. 6 illustrates a side view of a control pin according to an embodiment of the present invention.

Referencing FIGS. 5 and 6, according to certain embodiments, the control pin 50 includes a first end 54, a second end 60, and an intermediate portion 62. The first end 54 may include an engagement surface 64 that is configured to engage, during operation of the retention mechanism 46, at least a portion of the finger pin 48. Moreover, the engagement surface 64 may be configured to permit a sliding engagement between the engagement surface 64 and the finger pin 48 and/or an adjacent edge or wall 53 of the chamber 52. For example, according to certain embodiments, the engagement surface 64 may have a tapered, inclined, or generally rounded or partial spherical shape.

Additionally, according to certain embodiments, the engagement surface 64 may generally extend to the intermediate portion 62 of the control pin 50. The intermediate portion 62 may have a variety of different shapes and sizes. For example, according to the illustrated embodiment, the intermediate portion 62 may have a generally cylindrical configuration that is sized for lateral displacement along an orifice 66 of the shell body 14, as shown, for example, in FIG. 3. In the illustrated embodiment, the intermediate portion 62 includes a first portion 68 and a second portion 70, the first portion 68 having a larger diameter than the second portion 70. According to certain embodiments, such differences in sizes between the first and second portions 68, 70 may provide a back wall 71 against which a biasing element 58, such as, for example a spring, may exert a force against the control pin 50 that biases the control pin 50 toward the control lug 22. Alternatively, as shown, for example in FIG. 3, according to other embodiments, the biasing element 58 may engage the second end 60 of the control pin 50.

When the control lug 22 is in the disengaged position, the first end 54 of the control pin 50 may be biased against a front surface 56 of the control lug 22. As the control lug 22 is rotated toward and/or reaches the engaged position, the chamber 52 may be moved to a position adjacent to the control pin 50. With the chamber 52 adjacent to the control pin 50, the biasing element 58 may force the control pin 50 to move from a recessed position, wherein at least a substantial portion of the control pin 50 may be housed in the orifice 66, toward an extended position, wherein at least a portion of the control pin 50 is positioned in the chamber 52, as shown, for example in FIG. 10. For example, according to certain embodiments, the engagement surface 64 and at least a portion of the intermediate portion 62 of the control pin 50 may be positioned within the chamber 52 when the control lug 22 is in the engaged position. Thus, according to certain embodiments, at least the portion of the intermediate portion 62 that enters into the chamber 52 may have a configuration that resists a sliding engagement between the intermediate portion 62 and the adjacent edge or sidewall 53 of the control lug 22.

With the control lug 22 in the engaged position and at least a portion of the control pin 50 in the chamber 52, the control pin 50 may provide a barrier that prohibits the rotation of the control lug 22 back to the disengaged position. More specifically, at least the presence of the control pin 50 in the chamber 52 may prevent the control plug 22 from being rotated to a position in which the retention portion 26 of the control lug 22 would vacate the retention recess 13 of the lock housing 11. With the control lug 22 in the engaged position, and the associated retention mechanism 46 in the retention position, the lock cylinder 10 may not be removable from the lock housing 11.

Figure 7B:
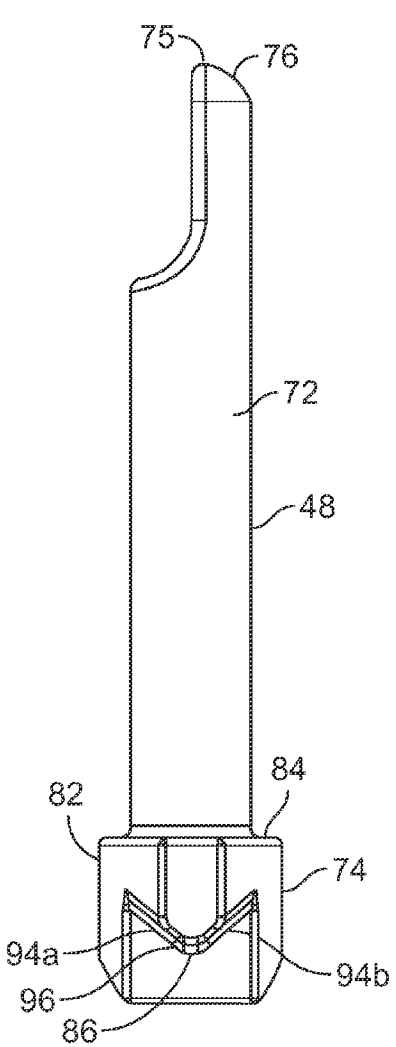
FIGS. 7A and 7B illustrate a first side perspective view and a second side view, respectively, of a finger pin according to an embodiment of the present invention.
Figure 7A:
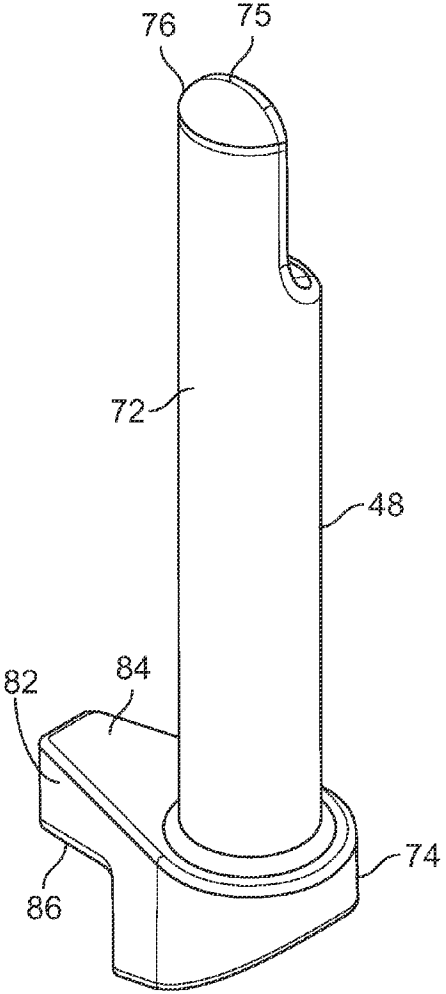

The subsequent removal of the control pin 50 from the chamber 52 of the control lug 22 may be achieved through the displacement of the finger pin 48 from a rest position to an activation position. Referencing FIGS. 7A-7B, according to certain embodiments, the finger pin 48 includes a shaft portion 72 that extends from a base portion 74. The shaft portion 72 includes a distal end 75 that has an activation surface 76. The activation surface 76 is configured to engage the engagement surface 64 of the control pin 50 when the control pin 50 is at least in the extended position and the finger pin 48 is in an activation position. The activation surface 76 may have a variety of different shapes and configurations that are configured to press upon and/or slidingly engage the engagement surface 64 of the control pin 50. For example, in the illustrated embodiment, the activation surface 76 may have a tapered, inclined or a generally round or partial spherical shape that is configured for a sliding engagement with the engagement surface 64 of the control pin 50.

Figure 3:
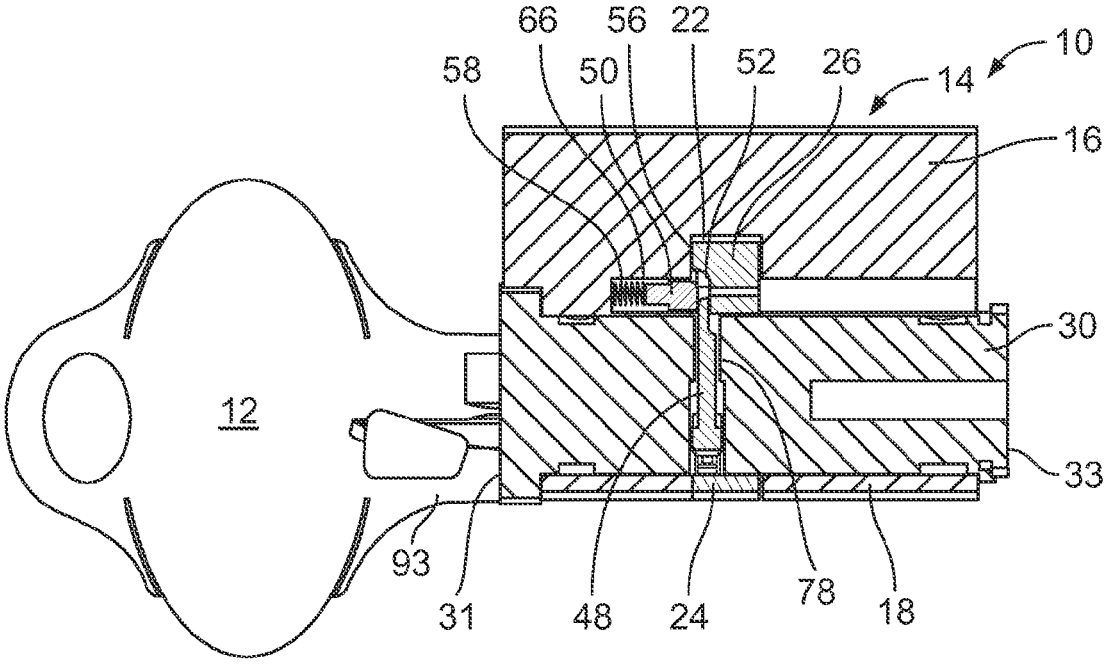
FIG. 3 illustrates a partial cross sectional view taken along line A-A in FIG. 1A of a lock cylinder having a retention mechanism in an intermediate position according to an embodiment of the present invention.
Figure 13:
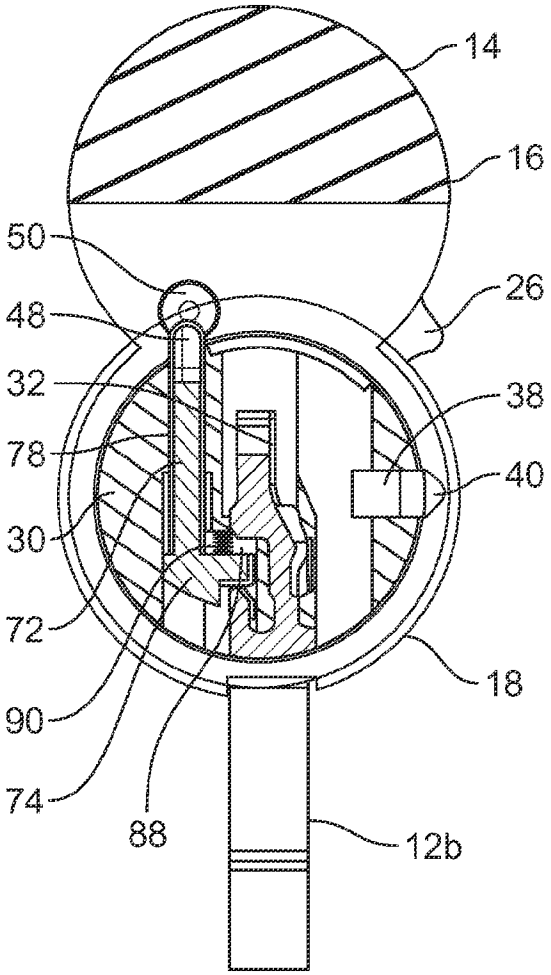
FIG. 13 is a cross sectional view of a lock cylinder with a retention mechanism in a release position according to an embodiment of the present invention.

At least a portion of the shaft 48 is configured for slidable displacement within a passageway 78 in the plug body 30, as shown, for example, in FIGS. 3, 9, and 13, such that at least a portion of the activation surface 76 may protrude out from the plug body 30 when the finger pin 48 is in the activation position. Further, according to certain embodiments, the cover 44 includes an opening 80 that may be generally aligned with the passageway 78 when the cover 44 is in an open position. Accordingly, when the finger pin 48 is in the activation position, at least a portion of the activation surface 76 may also protrude through the opening 80.

According to the illustrated embodiment, the base portion 74 includes an extension 82 having generally opposing first and second surfaces 84, 86. The extension 82 is configured to be positioned within an inner area 88 of the plug body 30, as shown, for example, in FIGS. 9 and 13. Moreover, according to certain embodiments, the extension 82 is configured to extend into the key slot 32. Additionally, according to certain embodiments, the first surface 84 is configured for engagement with a biasing element 90, such as, for example, a spring. As shown in at least FIGS. 8 and 12, the second surface 86 of the extension 82 is configured for engagement with a sidebit 92*a*, 92*b* that may be positioned on a sidewall 93 of a key 12*a*, 12*b*. Additionally, according to certain embodiments, the second surface 86 may include one or more transition surfaces 94*a*, 94*b* that may at least assist with the sidebit 94*a*, 94*b* coming into contact with a contact portion 96 of the second surface 86.

Figure 8:
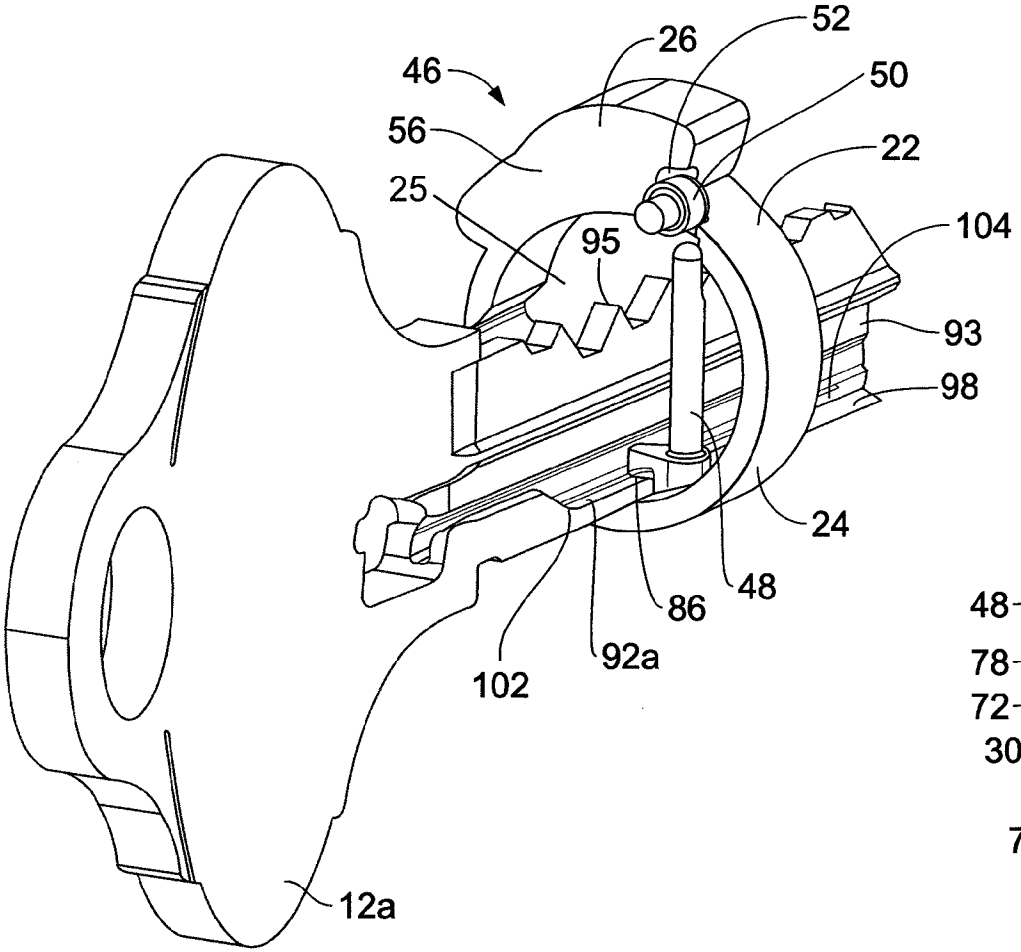
FIG. 8 illustrates a side perspective view of a retention mechanism in a retention position according to an embodiment of the present invention.
Figure 10:
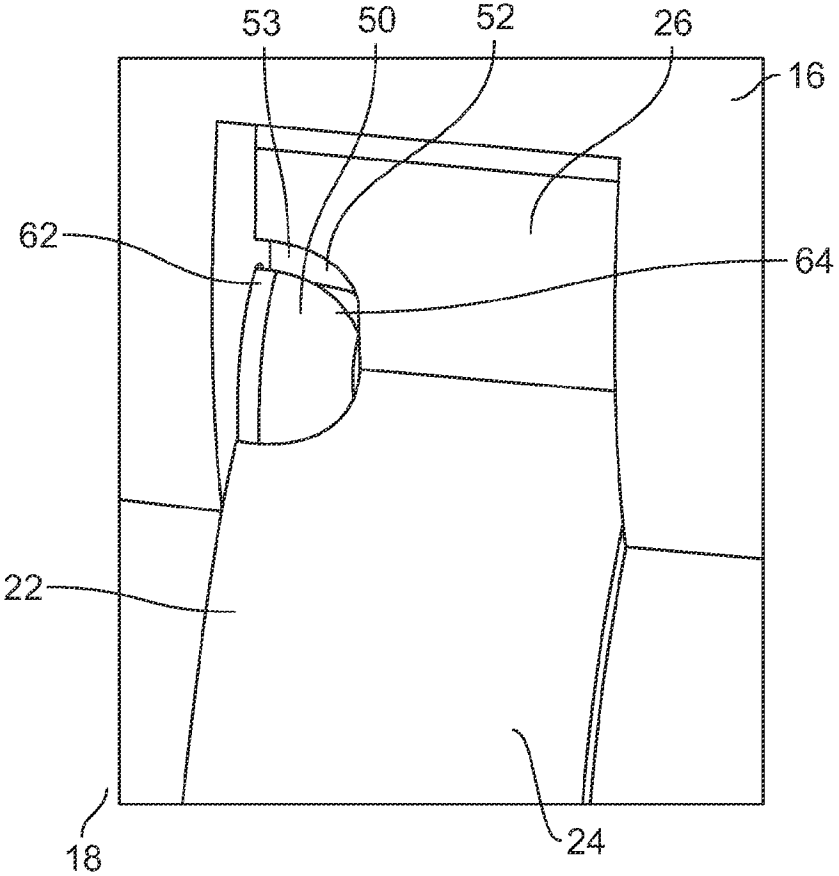
FIG. 10 illustrates a side perspective view of a portion of a lock cylinder in which the control pin is in an extended position within a chamber of a control lug according to an embodiment of the present invention.

Referencing FIGS. 8-10, when the retention mechanism 46 is to remain in the retention position, such that the lock cylinder 10 is to remain in the lock housing 11, the finger pin 48 is biased by the biasing element 90 to the rest position. In the illustrated embodiment, when in the rest position, the finger pin 48 is generally contained within the plug body 30 such that the finger pin 48 does not interfere with the ability to rotate the plug body 30 relative to the shell body 14 and/or the control lug 22. For example, according to the embodiment shown in FIG. 9, the biasing element 90 biases the base portion 74 toward a lower portion of the plug body 30, which causes the shaft portion 72 of the finger pin 48 to be generally retained within the passageway 78 of the plug body 30.

Figure 11:
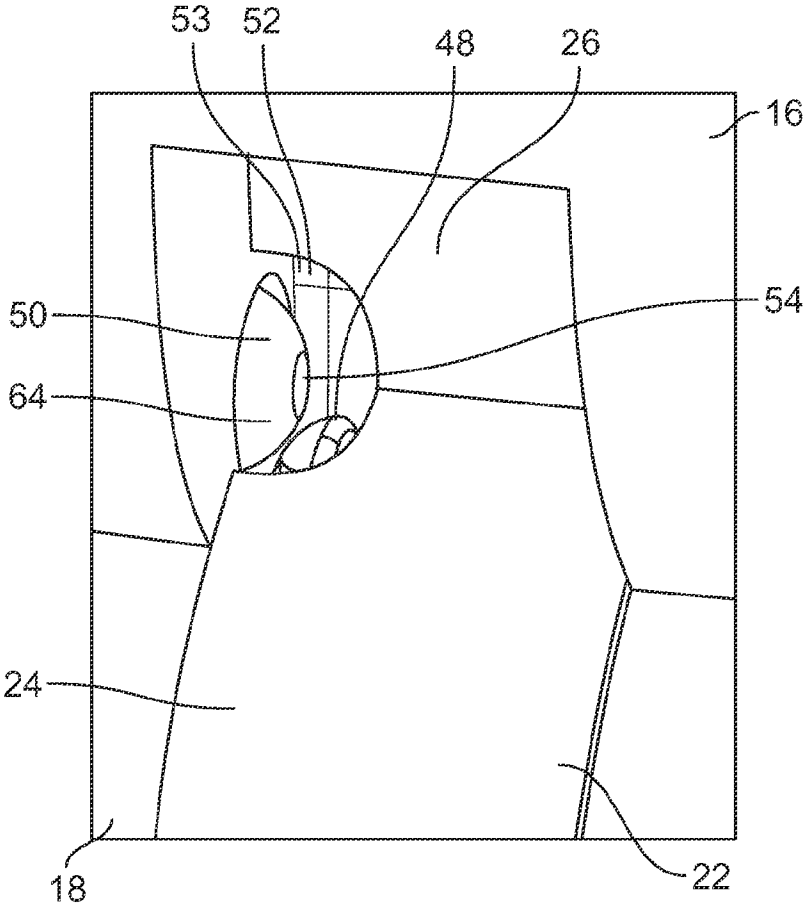
FIG. 11 illustrates a side perspective view of a portion of a lock cylinder in which a control pin is being displaced toward a recessed position according to an embodiment of the present invention.

However, when the finger pin 48 is displaced from the rest position to the activation position, as shown for example in at least FIG. 13, at least a portion of the finger pin 48 extends out the plug body 30, such as, for example, out of the passageway 78. Further, according to the illustrated embodiment, as the finger portion 48 extends out of the plug body 30 and through the opening 80 in the cover 44, the activation surface 76 of the finger plug 48 slidingly engages the engagement surface 64 of the control pin 50. As shown for example in FIGS. 3 and 11, the sliding engagement between the engagement and activation surfaces 64, 76 has sufficient force to overcome the biasing force of the biasing element 58 of the control pin 50, thereby causing the control pin 50 to be displaced back into the orifice 66 a sufficient distance so that the control pin 50 does not prohibit the control lug 22 from being rotably displaced to the disengaged position.

Additionally, according to certain embodiments, as the control lug 22 is rotably displaced toward the disengaged position, a wall 53 of the control lug 22 may also slidingly engage a portion of the engagement surface 64 of the control pin 50, thereby assisting in displacing the control pin 50 further into the orifice 66 and back toward the recessed position, until the control pin 50 is misaligned with the chamber 52 and instead returns to being biased against an adjacent front surface 56 of the control lug 22.

Figure 12:
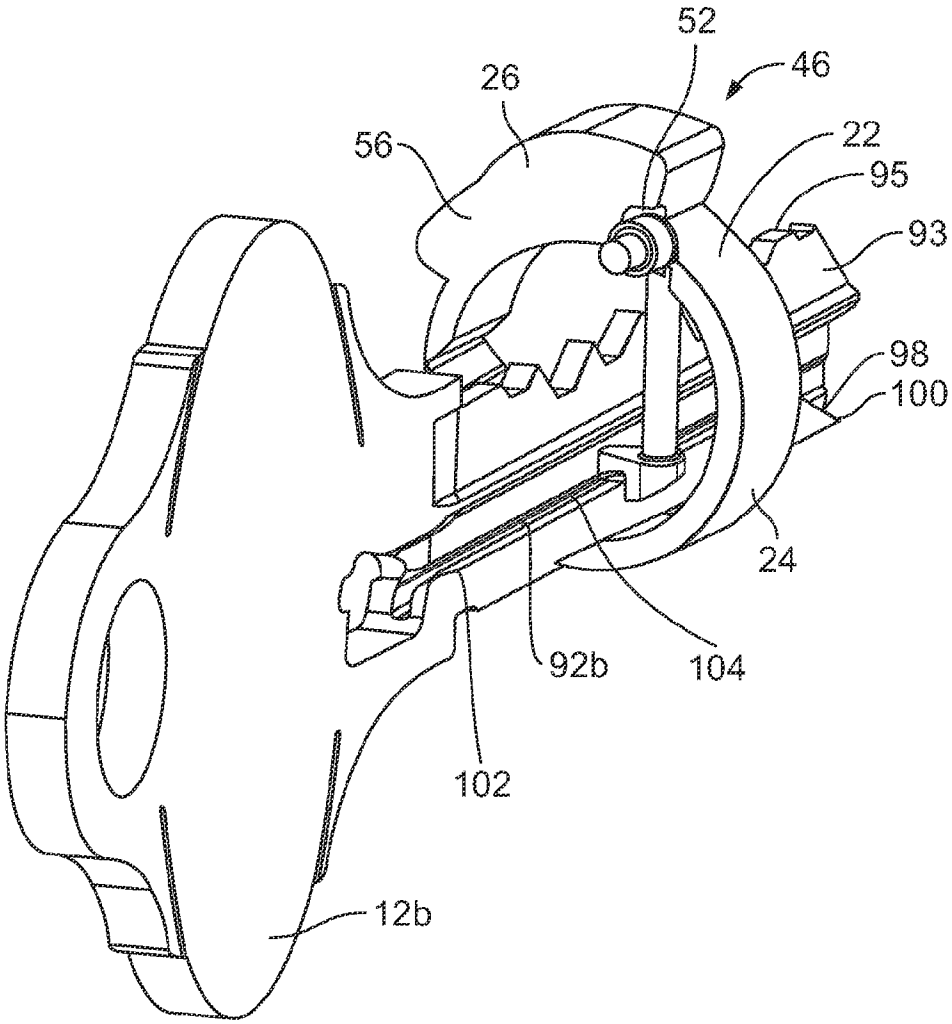
FIG. 12 illustrates a side perspective view of a retention mechanism in a release position according to an embodiment of the present invention.

Referencing FIGS. 8 and 12, in the illustrated embodiment, the displacement of the finger pin 48 to the activation position may be controlled by the configuration of a sidebit 92*a*, 92*b* of the key 12*a*, 12*b*. According to certain embodiments, the sidebit 92*a*, 92*b* includes a distal end 100, a proximate end 102, and a sidebit surface 104. The distal end 100 may include an inclined surface 98 that is configured to at least slidingly engage a transitional surface 94 of the finger pin 48 as the key 12*a*, 12*b* is inserted into the key slot 32. Moreover, the transitional and inclined surfaces 94, 98 may be configured to assist in the contact portion 96 of the finger pin 48 reaching and/or coming into contact with the sidebit surface 104.

The distance that the finger pin 48 is displaced as the inclined surface 98 is displaced along the transitional surface 94 and/or the contact portion 98 travels along the sidebit surface 104 may determine whether the finger pin 48 is displaced to the activation position, and thus whether the associated retention mechanism 46 may allow the control lug 22 to be rotated to the disengaged position. For example, FIG. 8 illustrates a first key 12*a*, such as, for example, an operating key, having a relatively small or shallow sidebit 92*a* configuration that does not displace the finger pin 48 to the activation position. Instead, as shown by FIG. 8 and further demonstrated by FIG. 9, when the sidebit 92*a* of the illustrated first key 12*a* travels along, or beneath the contact portion 96 of the finger pin 48, the finger pin 48 is not lifted to the activation position. Instead, the finger pin 48 generally remains in or around the rest position, wherein the finger pin 48 remains confined to being in the plug body 30, and therefore does not operably engage the control pin 50. Thus, according to such an embodiment, the first key 12*a* shown in FIG. 8 may be generally limited to uses in which the bitting configuration on a top surface 95 of the key 12*a* is used to displace retention pins 36 to allow rotational displacement of the plug body 30 for associated operation of a lock device.

Referencing FIG. 12, a second key 12*b*, such as, for example, a control key, has a sidebit 92*b* configuration that may displace the retention mechanism 46 from the retention position to the release position so that the lock cylinder 10 may be removed from the lock housing 11. For example, in contrast to the sidebit 92*a* configuration of the first key 12*a* shown in FIG. 8, in the embodiment shown in FIG. 12, the second key 12*b* has a sidebit 92*b* configuration having a sufficient height or depth to lift or otherwise displace the finger pin 48 from the rest position to the activation position. For example, as the transition surface 94 and/or contact surface 96 of the finger pin 48 contacts the inclined surface 98 of the sidebit 92, the distal end 75 of the shaft portion 72 may protrude through the passageway 78 of the plug body 30. According to certain embodiments, as the finger pin 48 is moved toward the activation position, the activation surface 76 of the finger pin 48 begins to contact the engagement surface 64 and displace the control pin 50 back into the orifice 66 and toward the recessed position, as shown, for example, in FIGS. 3 and 11.

Further, according to certain embodiments, the second key 12*b* may have a bitting configuration on the top surface 95 of the second key 12*b* that does not displace retention pins 36 to positions that would permit the plug body 30 to be rotated independently of the control lug 22. According to such embodiments, the plug body 30 and control lug 22 may be rotated together with the finger pin 48 remaining in the activation position. More specifically, the finger pin 48 may remain in the chamber 52 as the plug body 30 and control lug 22 are rotated together toward the disengage position of the control lug 22.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A retention mechanism for retaining a lock cylinder in a lock housing, the retention mechanism comprising:

a control lug having a chamber and a retention portion, the control lug configured for rotational displacement between a disengaged position and an engaged position in the lock cylinder, at least a portion of the retention portion configured to occupy at least a portion of a retention recess of the lock housing when the control lug is in the engaged position to prevent removal of the lock cylinder from the lock housing;

a control pin, at least a portion of the control pin configured to be displaced into the chamber and positioned to be engaged with the retention portion to prevent rotational displacement of the control lug from the engaged position; and a finger pin configured for displacement between a rest position and an activation position, the finger pin configured to slidingly engage a portion of the control pin while removably displacing at least a portion of the control pin from the chamber when the finger pin is displaced to the activation position, wherein the finger pin is displaceable in a first linear direction between the rest position and the activation position and the control pin displaceable in a second linear direction by engagement with the finger pin, the first linear direction being non-parallel to the second linear direction, at least a portion of the control pin being biased against a front surface of the control lug when the control lug is in the disengaged position.

2. The retention mechanism of claim 1, further including a biasing element configured to bias the control pin into the chamber when the control lug is in the engaged position.

3. The retention mechanism of claim 2, wherein the control pin is configured to be displaced between a recessed position and an extended position, at least a portion of the control pin being positioned in the chamber when in the extended position.

4. The retention mechanism of claim 3, wherein the control pin includes an engagement surface that is configured for sliding engagement with an activation surface of the finger pin, and wherein at least a portion of the engagement surface and at least a portion of the activation surface have generally rounded configurations.

5. The retention mechanism of claim 4, wherein the finger pin is configured to be confined to a plug body of the lock cylinder when in the rest position.

6. The retention mechanism of claim 5, wherein the finger pin includes a shaft portion and a base portion, the base portion configured to extend into a least a portion of a key slot of the plug body of the lock cylinder, and wherein the base portion includes a contact portion and a transition surface that are configured to engage a sidebit positioned along a sidewall of a key that is configured to lift the finger pin from the rest position to the activation position.

7. An interchangeable lock cylinder configured for securable placement in a lock housing, the interchangeable lock cylinder comprising:

a shell body having an aperture;

a plug body configured for rotational displacement about the aperture, the plug body having a key slot; and a retention mechanism having a control lug, a finger pin, and a control pin, the control lug having a chamber and an orifice, the orifice configured to receive the rotatable insertion of the plug body, the control pin configured for removable insertion into the chamber when the control lug is rotatably displaced to an engaged position, the finger pin being slideably displaceable along a surface of the control pin as the control pin is displaced from the chamber, at least a portion of the control pin biased against a front surface of the control lug when the control lug is in a disengaged position.

8. The interchangeable lock cylinder of claim 7, wherein the control pin is configured to be to engageable with a portion of the retention portion to prevent the rotational displacement of the control lug from the engaged position to a disengaged position when the control pin is operably positioned within the chamber, and wherein the finger pin is displaceable in a first direction and the control pin is displaceable in a second direction as the finger pin is slideably displaced along the surface of the control pin, the first direction being non-parallel to the second direction.

9. The interchangeable lock cylinder of claim 8, further including a biasing element configured to bias the control pin into the chamber when the control lug is in the engaged position.

10. The interchangeable lock cylinder of claim 9, wherein the control pin is configured to be displaced between a recessed position and an extended position, at least a portion of the control pin being positioned in the chamber when in the extended position.

11. The interchangeable lock cylinder of claim 10, wherein the control pin includes an engagement surface against which an activation surface of the finger pin engages as the finger pin is slideably displaced along the control pin, and wherein at least a portion of the engagement surface and at least a portion of the activation surface have generally round configurations.

12. An interchangeable lock cylinder system comprising:

a plug body having a key slot;

a retention mechanism having a control lug, a finger pin, and a control pin, the control lug having a chamber and an orifice, the orifice configured to receive rotatable insertion of the plug body, the control pin configured for removable insertion into the chamber when the control lug is rotatably displaced to an engaged position; and a key having at least a top surface and a sidewall, the key further including a sidebit positioned along the sidewall, the key configured to be inserted into the key slot, the sidebit configured to displace the finger pin from a rest position to an activation position, the finger pin configured to slidingly engage the control pin as the finger pin removably displaces the control pin from the chamber as the sidebit lifts the finger pin to the activation position wherein the control pin is configured to prevent the rotational displacement of the control lug from the engaged position to a disengaged position when the control pin is operably positioned within the chamber, and wherein the finger pin is displaceable in a first direction and the control pin is displaceable in a second direction as the finger pin is slideably displaced along a surface of the control pin, the first direction being non-parallel to the second direction.

13. The interchangeable lock cylinder system of claim 12, wherein the control pin is configured to be displaced between a recessed position and an extended position, at least a portion of the control pin being biased by a biasing element into in the chamber when the control pin is in the extended position.

14. The interchangeable lock cylinder system of claim 12, wherein the finger pin is biased to a rest position by a biasing element, and wherein the finger pin is configured to be confined to the plug body when the finger pin is in the rest position.

15. The interchangeable lock cylinder system of claim 14, wherein the finger pin includes a shaft portion and a base portion, the base portion configured to extend into a least a portion of the key slot.

16. The interchangeable lock cylinder system of claim 15, wherein the base portion includes a contact portion and a transition surface that are configured to engage the sidebit of the key.

17. An interchangeable lock cylinder configured for securable placement in a lock housing, the interchangeable lock cylinder comprising:

a shell body having an aperture;

a plug body configured for rotational displacement about the aperture, the plug body having a key slot; and a retention mechanism having a control lug, a finger pin, and a control pin, the control lug having a chamber and an orifice, the orifice configured to receive the rotatable insertion of the plug body, the control pin configured for removable insertion into the chamber when the control lug is rotatably displaced to an engaged position, the finger pin slideably displaceable along a surface of the control pin as the control pin is displaced from the chamber, wherein the finger pin is biased to a rest position by a first biasing element, and wherein the finger pin is configured to be confined to the plug body when in the rest position, wherein the control pin is configured to prevent the rotational displacement of the control lug from the engaged position to a disengaged position when the control pin is operably positioned within the chamber, the finger pin being displaceable in a first direction and the control pin being displaceable in a second direction as the finger pin is slideably displaced along the surface of the control pin, the first direction being non-parallel to the second direction, and wherein a second biasing element is configured to bias the control pin into the chamber when the control lug is in the engaged position.

18. The interchangeable lock cylinder of claim 17, wherein the control pin is configured to be displaced between a recessed position and an extended position, at least a portion of the control pin being positioned in the chamber when in the extended position.

19. The interchangeable lock cylinder of claim 18, wherein the control pin includes an engagement surface against which an activation surface of the finger pin engages as the finger pin is slideably displaced along the control pin, and wherein at least a portion of the engagement surface and at least a portion of the activation surface have generally round configurations.

20. The interchangeable lock cylinder of claim 17, wherein the finger pin includes a shaft portion and a base portion, the base portion configured to engage a sidebit positioned along a sidewall of a key that is configured to at least assist in displacing the finger pin to an activation position.

* * * * *